US005191352A

United States Patent [19]

Branson

[11] Patent Number: 5,191,352

[45] Date of Patent: Mar. 2, 1993

[54] RADIO FREQUENCY APPARATUS

[75] Inventor: Sidney J. Branson, Peterborough, England

[73] Assignee: Navstar Limited, United Kingdom

[21] Appl. No.: 735,881

[22] Filed: Jul. 25, 1991

[30] Foreign Application Priority Data

Aug. 2, 1990 [GB] United Kingdom ..... 9016929
Apr. 29, 1991 [GB] United Kingdom ..... 9109190

[51] Int. Cl.[5] ..... H01Q 1/36; H01Q 21/20
[52] U.S. Cl. ..... 343/895; 343/850
[58] Field of Search ..... 343/895, 700 MS File, 343/850, 852, 878, 872

[56] References Cited

U.S. PATENT DOCUMENTS

| | | | |
|---|---|---|---|
| 2,835,893 | 5/1958 | Braund | 343/895 |
| 4,295,144 | 10/1981 | Matta et al. | 343/895 |
| 4,608,574 | 8/1986 | Webster et al. | 343/895 |

FOREIGN PATENT DOCUMENTS

| | | |
|---|---|---|
| 0241921 | 4/1987 | European Pat. Off. . |
| 0320404 | 12/1988 | European Pat. Off. . |
| 0030006 | 2/1988 | Japan . |
| 650041 | 8/1947 | United Kingdom . |
| 840850 | 7/1956 | United Kingdom . |
| 2050701 | 1/1981 | United Kingdom . |

OTHER PUBLICATIONS

Kilgus, "Resonant Quadrifilar Helix Design", the Microwave Journal, Dec. 1970, pp. 49–54.

*Primary Examiner*—Rolf Hille
*Assistant Examiner*—Hoanganh Le
*Attorney, Agent, or Firm*—F. Eugene Davis, IV

[57] ABSTRACT

A quadrifilar radio frequency antenna intended primarily for receiving signals from an earth orbiting satellite for navigation has four helical wire elements shaped and arranged so as to define a cylindrical envelope. The elements are co-extensive in the axial direction of the envelope and are mounted at their opposite ends in two printed circuit boards lying in spaced apart planes perpendicular to the axis with the end parts of the elements being soldered to conductor tracks on the boards, the tracks constituting impedance elements between the helical elements and between the helical elements and an axially located coaxial feeder. The conductor tracks are such that the effective length of one pair of helical elements and associated impedance elements is greater than that of the other pair and associated impedance elements. In this way, phase quadrature between the two pairs is obtained at the operating frequency without using differently shaped helical elements, and with little or no adjustment of the elements in the manufacturing process.

18 Claims, 3 Drawing Sheets

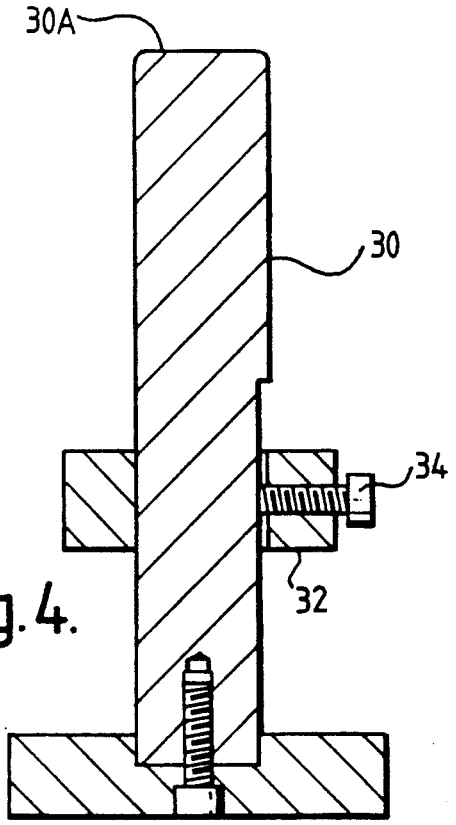
Fig. 4.
Fig. 5.
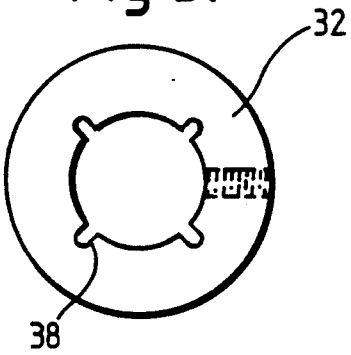
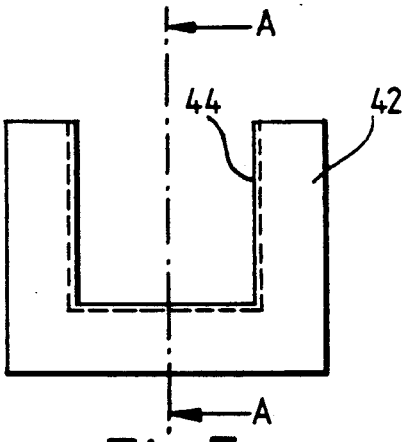
Fig. 7.
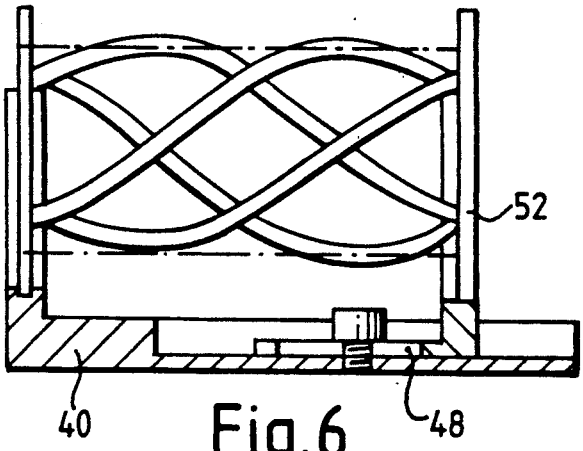
Fig. 6.
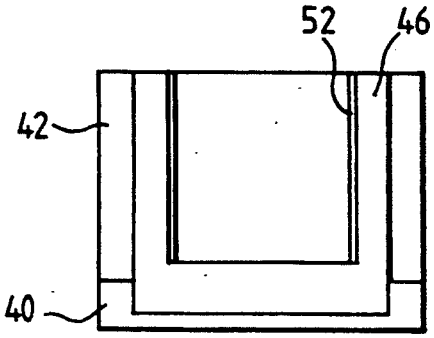
Fig. 8.

RADIO FREQUENCY APPARATUS

FIELD OF THE INVENTION

This invention relates to a radio frequency antenna having a plurality of substantially helical elements, and to a method of manufacturing such an antenna.

BACKGROUND OF THE INVENTION

It is known that an antenna with a plurality of resonant helical elements arranged around a common axis can be made to exhibit a dome-shaped spatial response pattern which is particularly useful for receiving signals from satellites. Such an antenna is disclosed in "Multielement, Fractional Turn Helices" by C. C. Kilgus in IEEE Transactions on Antennas and Propagation, July 1968, pages 499 and 500. This paper teaches, in particular, that a quadrifilar helix antenna can exhibit a cardioid characteristic in an axial plane and be sensitive to circularly polarised emissions. The antenna comprises two bifilar helices arranged in phase quadrature and coupled to an axially located coaxial feeder via a split tube balun for impedance matching. While antennas based on this prior design are widely used because of the particular response pattern, they have the disadvantages that they are extremely difficult to adjust in order to achieve phase quadrature and impedance matching, due to their sensitivity to small variations in element length and other variables, and that the split tube balun is difficult to construct. As a result, their manufacture is a very skilled and expensive process.

It is an object of this invention to provide an antenna which achieves similar performance to those of the prior art at lower cost.

SUMMARY OF THE INVENTION

According to a first aspect of this invention, a radio frequency antenna comprises a plurality of helical elements arranged around a common axis, a substantially axially located feeder structure, and a plurality of separately formed coupling elements forming conductive paths between the helical elements and the axis. The coupling elements are preferably located at the ends of the helical elements in the form of, for instance, radially extending conductors connecting those ends to the feeder structure. Such coupling elements may be located at one or both ends of each helical element, and may be radially directed or may follow a longer path between the respective elements and the axis. Arranging for the coupling elements to have different electrical lengths is one way of providing different coupling impedances for respective helical elements so that, for example, an antenna can have differently phased pairs of helical elements. In particular, the helical elements may be supported by two spaced apart insulative and preferably planar mounting members such as printed circuit boards extending perpendicularly to the common axis, the coupling elements being conductive tracks formed on one or both boards. Alternatively wire loops may be used for the coupling elements. By forming the coupling elements and the mounting members separately from the helical elements, both can be relatively accurately formed with predetermined shapes and dimensions so that, when assembled together, relatively little, if any, adjustment is required to obtain an antenna having the required characteristics. In this way, much of the need for skill and time in manufacturing and adjusting the prior art antennas is avoided. In the preferred embodiment of the invention, the helical elements are simple helical lengths of copper wire all of the same dimensions and each with no more than very small end portions which depart from the helical path, while the impedance elements are printed circuit tracks of fixed shapes and dimensions. Both types of elements can, as a result, be mass-produced to precise dimensions.

In one preferred embodiment of the invention each helical element executes a half turn around a cylindrical envelope, but other fractional turn elements may be used in other embodiments, and indeed it is possible to use elements having more than one turn.

The preferred embodiment of the invention is a quadrifilar antenna in that it has four helical elements arranged so as to define a cylindrical envelope centred on the common axis, the elements all having the same diameter and being coextensive in the axial direction. They are mounted at opposite ends in two printed circuit boards lying in spaced apart planes perpendicular to the axis, the end parts of the elements being located in holes in the boards where they are soldered to printed conductors running between the holes and the axis. On one board the conductors are connected to the end of a feeder, two of the elements being thereby connected to one conductor of the feeder, and the other two being connected to the other feeder conductor, the feeder preferably being of coaxial type. On the other board the elements are linked to a common connection on the axis, but here the conductors from two of the elements are longer than the conductors from the other two elements the length difference being such that at the operating frequency, one pair of helical elements operates 90° out of phase with respect to the other pair.

The axial length of the helical elements (which is the distance between the outer surfaces of the printed circuit boards in the preferred embodiment) is preferably in the range 0.25λ to 0.40λ where λ is the operating wavelength, while the diameter is typically between 0.08λ and 0.18λ. From a ratio aspect, the ratio of the element length to element diameter may typically be in the range of 1.25 to 3.5, with the range of 2.0 to 3.0 being preferred. The thickness of the helical elements affects the bandwidth of the antenna. In the preferred embodiment the elements are about 0.01λ thickness.

The difference in length between the conductors on the said other printed circuit board may be achieved by forming the conductors for one pair of helical element as straight radial tracks, but the conductors for the other pair as longer tracks between the axis and the ends of the respective helical elements. These longer tracks may take the form of loops or be meandered, for example. Thus, the longer tracks may comprise two semi-circular loops each having an inner radius of 0.020λ to 0.025λ and width of 0.005λ to 0.010λ.

For mechanical strength, it is advantageous to mount both printed circuit boards on the feeder, with the feeder running from its connections on the one board axially through the antenna and through the other board to a termination spaced some distance along the axis from the helical elements. It is then possible to form the common connection of the conductors on the board opposite the feed end as a printed ring around the feeder which may soldered to the feeder screen conductor. In this case the antenna thus consists of no more than the helical wire elements, two printed circuit boards, and a semi-rigid or rigid coaxial feeder. If protection from the weather is required, the antenna may additionally include a radome. In the preferred embodiment this is a plastics tube with an end cap.

Alternative embodiments within the scope of the invention include an antenna having radiating elements which are helical in the sense that they each form a coil or part coil around an axis but also change in diameter from one end to the other. For example, while the preferred embodiment has helical elements defining a cylindrical envelope, it is possible to have elements defining instead a conical envelope or another surface of revolution. The invention also includes an antenna in which the helical elements are supported by alternative separately formed elements connected to the feeder structure. For instance, one of the supporting elements may be insulative, while another may be wholly conductive. Thus, the helical elements may each have one end mounted in an insulative printed circuit board having conductive tracks connecting the elements to the feeder structure, while their other ends may be mounted in a metallic plate or a board having a continuous plated layer. Alternatively, the helical elements may be so mounted that each has one of its ends insulated from the feeder structure.

According to a second aspect of the invention, there is provided a method of making a radio frequency antenna which has a plurality of helical elements arranged around a common axis, a substantially axially located feeder structure, and at least two mounting members at least one of which is insulative and bears coupling elements forming radio frequency conductive paths between the helical elements and the axis, wherein the method comprises: locating the helical elements with their axes coincident and with their respective ends lying in two spaced apart planes perpendicular to the common axis; securing a first of the mounting members to the helical element ends in one of the planes; bringing together the second of the mounting members and the assembly of the first mounting member and the helical elements so that the second mounting member is in a predetermined position parallel to and axially spaced from the first mounting member in which it is located on the other ends of the helical elements; securing the said other mounting member to the said other ends; and attaching the feeder structure to one or both mounting members. The feeder structure may be attached to one or both mounting members before or after bringing the said other mounting member into position on the helical elements.

In the preferred method, the helical elements are located around a cylindrical mandrel with one end of each element projecting beyond the end of the mandrel, and they are held against the mandrel by an outer tube. The first mounting member is then placed on the projecting ends and the conductors on the member are soldered to the ends. The assembly is removed from the mandrel and placed in a jig which has two parts slidable relative to each other. The first mounting member is fitted into one part of the jig and the second mounting member into the other. The jig is arranged such the mounting members can be moved towards each other in an axial direction by sliding the jig parts, but, in the required relative positions at least, they are held perpendicular to the common axis and at fixed rotational positions with respect to each other. This means that when the second mounting member is brought onto the unattached ends of the helical elements, it is in the precise required relationship with the first mounting member before it is secured. The conductors on the second mounting member are then soldered to the helical element ends, and the feeder structure is also soldered to the members. The resulting antenna is then removed from the jig.

BRIEF DESCRIPTION OF THE DRAWINGS

The invention will now be described by way of example with reference to the drawings in which:

FIG. 4 is a sectional side elevation of a first jig for manufacturing the antenna;

FIG. 5 is a plan view of collar element of the jig of FIG. 4;

FIG. 6 is a sectioned side elevation of a second jig for manufacturing the antenna viewed on the line A—A in FIG. 7 showing parts for the antenna of FIG. 1 fitted in the jig;

FIG. 7 is an end elevation of part of the second jig;

FIG. 8 is an end elevation of another part of the second jig;

DETAILED DESCRIPTION OF THE PREFERRED EMBODIMENTS

Figure 1:
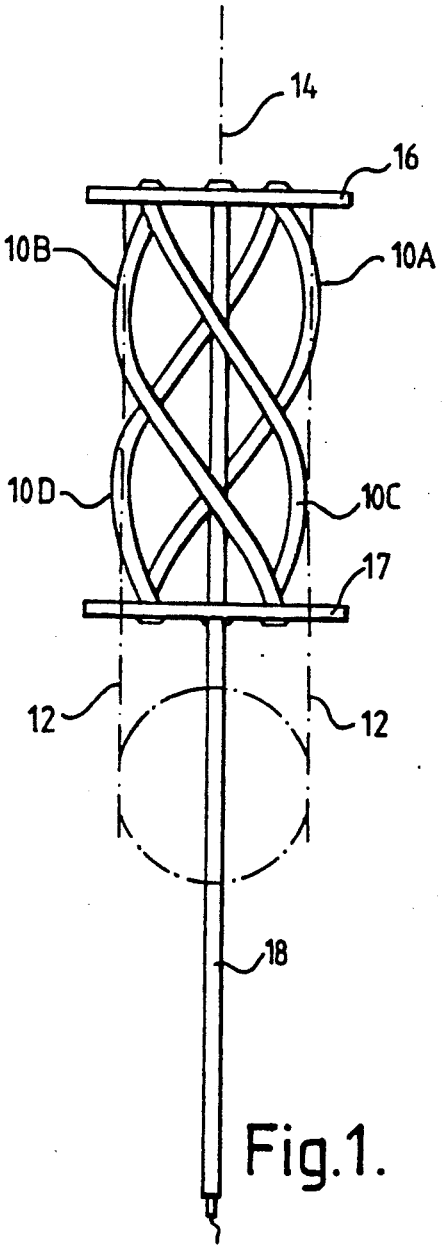
FIG. 1 is a side elevation of a quadrifilar helical antenna in accordance with the invention.

Referring to FIG. 1 of the drawings, a quadrifilar antenna has four helical elements 10A, 10B, 10C, and 10D of equal length and each bent to form a half turn around a cylindrical envelope (shown by the chain lines 12). The elements 10A to 10D are thus spaced at a constant radius from a common central axis 14, and they are arranged so as to be coextensive in an axial direction. Two mounting members in the form of a pair of printed circuit boards 16, 17 spaced apart and lying perpendicular to the axis 14 serve to support the respective ends of the helical elements 10A to 10D, and a rigid coaxial feeder 18 is secured at the centre of both boards, and runs axially between the boards and below the second board 17 to a termination (not shown) some distance from the helical elements.

Figure 2:
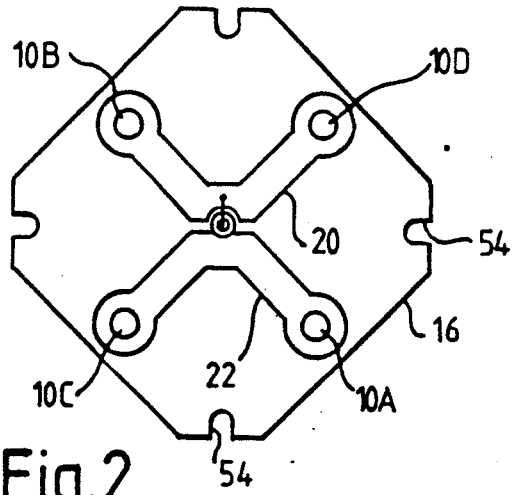
FIG. 2 is a top plan view of the antenna of FIG. 1.
Figure 3:
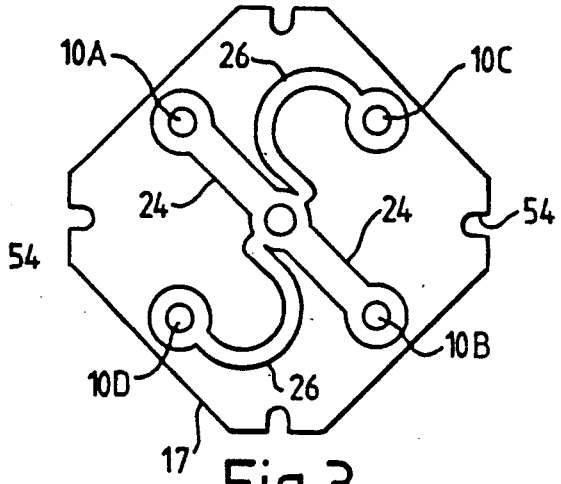
FIG. 3 is a bottom plan view of the antenna of FIG. 1.

As will be seen from FIGS. 2 and 3, the printed circuit boards 16, 17 bear coupling elements in the form of plated conductors 20, 22, 24, 26 which connect the ends of the helical elements 10A to 10D to the feeder 18 on the board 16, and with each other on the board 17. In practice, the boards 16, 17 have holes drilled through them to receive the ends of the helical elements 10A to 10D and the feeder 18, and the connections are made by soldering on those faces of the boards 16, 17 which face away from each other. Referring to FIG. 2, the inner conductor of the coaxial feeder 18 is connected to a V-shaped plated conductor 20 on the board 16 and the ends of the arms of the V are connected to the upper ends of the helical elements 10B and 10D, these ends being spaced apart around the circumference of the cylinder 12 by 90°. The screen of the feeder 18 is connected to a similar V-shaped conductor 22 which is formed as a virtual mirror image of the conductor 20 and is connected to the upper ends of the helical elements 10A and 10C. By following the path of the element 10A in FIG. 1 and then referring to FIG. 3 it will be seen that the lower end of element 10A penetrates the lower printed circuit board 17 at a position diametrically opposite the position of its upper end and at the end of one of a pair of oppositely located radial conductors 24 plated on the lower board 17. The other radial conductor 24 is connected to the lower end of element 10B whose upper end is connected to the inner conductor of the feeder via conductor 20 on the upper board 16. As a result, the helical elements 10A and 10B, portions of the conductors 20 and 22 and the conductors 24 together form a helical loop having one side connected to the inner conductor of the feeder 18 and the other side connected to the feeder outer screen. By comparing FIGS. 1, 2, and 3, a similar helical loop can be identified comprising helical elements 10C, 10D, the other parts of conductors 20 and 22, and looped conductors 26 on the lower board 17. Again, this second helical loop has one side connected to the inner conductor of the feeder 18 and the other side connected to the feeder outer screen.

It is important to note, that while the dimensions of the helical elements 10C and 10D are the same as the elements 10A and 10B, the presence of the looped or curved conductors 26 on the lower board 17 gives the second loop greater length than the first. It follows that the resonant frequency of the second loop is below that of the first. Consequently, at the end of the feeder 18 where it meets the board 16, signals in the first loop at a frequency midway between the two resonant frequencies will appear at the end of the feeder, out of phase with signals at the same frequency in the second loop. The dimensions of the looped conductors 26 in relation to the dimensions of the other elements of the helical loops are such that the phase difference is substantially 90°. It is this property of a phase shift between the pairs of helical elements that gives the antenna a cardioid response in space at the centre frequency, the peak of the response occurring at the zenith, i.e. on the axis 14 in a direction opposite to that of the feeder 18. As shown, the antenna is sensitive to right hand circularly polarized signals and tends to reject left hand polarised signals. By rotating either of the printed circuit boards 16, 17 through 90° about the axis so that the arrangement of the connections of the elements 10A to 10D is altered and altering the direction of rotation of these elements, the antenna can be made to be sensitive to left hand circularly polarized signals.

The feeder 18 is preferably made form so-called semi-rigid coaxial cable so that the antenna can, to a degree, be made self-supporting. In the preferred embodiment, the feeder cable has a characteristic impedance of 50 ohms, and the dimensions of the helical elements, particularly their length and thickness, and the lengths and thickness of the conductors on the printed circuit boards 16, 17 are chosen to produce a matching 50 phms antenna impedance at the centre frequency.

Taking as an example an antenna for L-band GPS reception at 1575 MHz, the axial length and thickness of the helical elements 10A to 10D are approximately 60 mm and 2.0 mm respectively. The diameter of the cylindrical envelope 12 is approximately 23 mm, and the lengths of the conductors on the printed circuit boards 16, 17 are such that the effective electrical length of each loop is approximately half of the wave-length at the respective resonant frequency.

In this example, it has been found that the required 90° phase difference can be obtained if the loops of the conductors 26 have an inside radius of about 4.19 mm and a width of about 1.52 mm. The other printed conductors are 3.05 mm wide.

Characteristic impedances other than 50 ohms may be obtained at the end of the feeder 18 by varying the length and spacing of the conductive parts comprising the helical elements and the printed circuit board conductors. Indeed, fine adjustments can be made during assembly by rotating the lower printed circuit board 17 by a few degrees one way or the other on the feeder prior to soldering it to the conductors 24 and 26. Rotating the board one way causes the diameter of the helical elements to be reduced and the spacing between the boards to be increased, while rotating it the other way increases the diameter and reduces the spacing. In this way, the matching of the antenna and the adjustment of its centre frequency can be optimised.

As mentioned hereinbefore, forming the elements 10A to 10D as simple helices considerably aids the ease with which the antenna can be manufactured. In practice, each helical element is formed with a small end part (not shown) which deviates from the helical path and is parallel to the central axis. This allows each helical element to be fitted easily and accurately in the predrilled and equally circumferentially spaced holes in the boards 16 and 17. In the preferred antenna, no other deviations from the helical path are required. The helical elements can, as a result, be constructed to relatively close tolerances. It is well known that conductors formed on printed circuit boards by photographic techniques can be produced to extremely close tolerances. Consequently, all parts of the two loops making up the antenna can be produced accurately to yield assemblies which show a high degree of repeatability in production, to the extent that the only adjustment required to meet a specification similar to that achieved by prior art antennas is a small rotation of one board with respect to the other as mentioned above while monitoring the variation of the standing wave ratio of a signal applied to the lower end of the feeder at the centre frequency.

The method of manufacturing the antenna will now be described with reference to FIGS. 4 to 8 and 10.

The helical elements are formed by winding copper wire around a cylindrical former (not shown) having helical groves. The former is of a size such that, initially, the wire is wound to a slightly smaller diameter than the required diameter so that it springs back to the required diameter when removed from the former.

Figure 10:
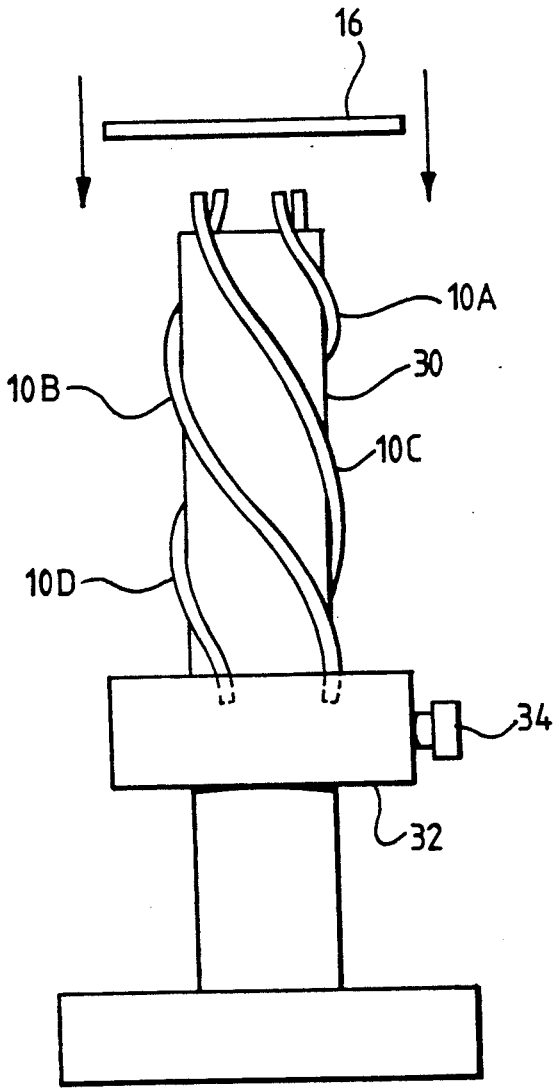
FIG. 10 is a side elevation of the first jig for manufacturing the antenna, showing helical elements of the antenna mounted on the jig.

Having produced in this way four helical elements of the required length and with end parts bent to lie parallel to the central axis, these four elements are placed in a first jig illustrated in FIGS. 4 and 5 in the manner shown in FIG. 10. This jig comprises a central mandrel 30 and a vertically slidable collar 32 having a grub screw 34 for engaging a flat 36 cut in the side of the cylindrical mandrel 30. By forming four equally spaced grooves 38 parallel to the axis in the interior surface of the collar 32, as shown in FIG. 5, the helical elements may be located around the mandrel 30 with, in each case, one end located in a respective groove 38 so that the elements are equally spaced around the mandrel and are coextensive lengthwise. The height of the collar 32 is set such that the other end parts of the helical elements, and only those parts, project above the top face 30A of the mandrel 30. Next, a tube (not shown) is placed over the helical elements around the mandrel 30. This tube is a tight fit so that the helical elements are held tightly in place. With the elements so held, one of the printed circuit boards 16 is placed over the projecting end parts as shown in FIG. 10 with the printed conductors uppermost, and the required soldered connections are formed.

The assembly of this first printed circuit board and the helical elements is removed from the first jig and placed in a second jig shown in FIGS. 6 to 8.

Referring to FIGS. 6 to 8, the second jig comprises a base member 40 having at one end an upright U-shaped yoke 42 with an inner groove 44. A second upright yoke 46 joined to a horizontal base plate 48 is mounted on the base member 40 so that the two yokes are parallel and spaced apart, the spacing being adjustable by virtue of the fact that the base plate 48 is slidable on the base member 40, its position being lockable by means of a screw 50. The second yoke 46 has an outwardly facing rebate 52.

The next stage in the assembly of the antenna consists of mounting the first printed circuit board in the groove 44 of yoke 42 so that the helical elements extend towards the yoke 46. It will be noted that the yoke 42 forms three sides of a square so that the first printed circuit board is fixed both in its axial position and its rotational position. The rebate 52 of the second yoke 46 is similarly formed so that when the other printer circuit board is placed in the rebate, its axial and rotational position with respect to the first board is fixed. With the relative position of the two yokes set to the required spacing of the boards, the second board can be offered up to the ends of the helical elements and located on those ends which engage in the holes in the board. With the board held against the shoulders of the rebate, soldered connections are made between the ends of the helical elements and the conductors on the board.

With the printed circuit boards still held in position in the second jig, the feeder cable can be threaded through central holes in both boards and soldered connections made at the end of the feeder.

Next, the assembly is removed from the second jig and the testing and adjustment procedure mentioned above is performed prior to soldering the lower board 17 to the feeder screen.

Figure 9:
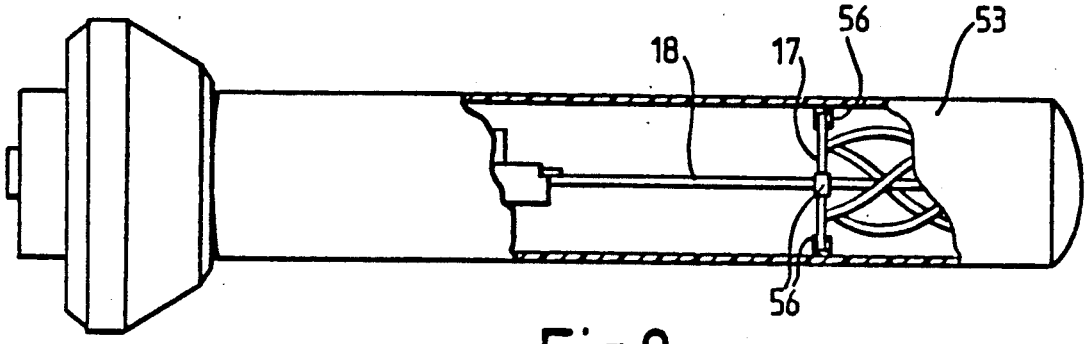
FIG. 9 is a fragmentary side elevation of the combination of the antenna of FIG. 1 mounted in a radome.

Final stages of manufacture include the spraying of the antenna with a protective plastics coating, and mounting it in a plastics tubular radome 53 together with a preamplifier and mixer, if required, as shown in FIG. 9. It will be noticed from FIGS. 2 and 3 that the printed circuit boards, 16, 17 have notches 54 cut in their peripheries. These notches receive small rubber grommets 56 which bear against the inner surface of the tubular radome 53. This allows the use of a radome having a poor tolerance on its internal diameter, since the variation in diameter is allowed for by the flexibility of the grommets 56, yet, due to the equal spacing of the grommets around the axis of the antenna, the antenna remains centrally located within the radome 53, thereby substantially avoiding the introduction of unsymmetrical variations in the spatial response characteristic of the antenna. In effect then, the printed circuit boards form spaced planar mounting members transversely located for mounting a plurality of antenna elements extending in a longitudinal direction in a tubular casing. The grommets form resilient spacing elements for engaging the inner surface of the casing.

The antenna structure described above has coupling elements at both the distal end and the proximal end of the antenna, each element forming part of one of a pair of bifilar helices arranged around a central axial feeder. The feeder is a 50 ohm coaxial cable terminating at the distal end. Other arrangements are possible within the scope of the invention. For instance, coupling elements may be provided only at one end of the antenna, these elements being of different lengths to obtain the required phasing of the antenna parts. Thus, the proximal ends of the helical elements may be secured to a conductive plate perpendicular to the feeder with the coupling elements being located all at the distal ends.

It is not essential for the feeder structure to have a single characteristic impedance of, say, 50 ohms. The feeder structure may, then, include a portion of a difference characteristic impedance to present a different (real or reactive) impedance to, for example, the distal end of the antenna, while matching to a 50 ohm feeder at the proximal end.

I claim:

1. A radio frequency antenna comprising at least two pairs of helical elements formed as helices having a common central axis, a substantially axially located feeder structured, and at least two coupling structures which are formed separately from the helical elements, the helical elements extending between said coupling structures, wherein each coupling structure includes coupling elements which form radio frequency conducting paths between the helical elements and said axis and which are located in a single respective plane, and wherein the coupling elements of at least one of the structures are of different electrical impedances, those associated with a first of said pairs of helical elements having a difference electrical impedance from those associated with a second of said pairs of helical elements.

2. An antenna according to claim 1, wherein the coupling elements are located at ends of the helical elements.

3. An antenna according to claim 2, wherein the coupling elements include radially extending conductors connecting the said ends of the helical elements to the feeder structure.

4. An antenna according to claim 3, wherein the radially extending conductors have different electrical lengths.

5. An antenna according to claim 1, wherein each coupling structure comprises an electrically insulative mounting member extending perpendicularly to the axis, the helical elements being supported by said member.

6. An antenna according to claim 5, wherein each insulative member comprises a printed circuit board, and wherein the coupling elements are conductive tracks formed on the board.

7. An antenna according to claim 6, wherein each printed circuit board is mounted on the feeder structure, which extends along the common axis.

8. An antenna according to claim 6, wherein the feeder structure is a semi-rigid coaxial feeder line.

9. An antenna according to claim 7, wherein the feeder structure is a rigid coaxial feeder line.

10. An antenna according to claim 6, having four of the said helical elements all substantially identical to each other and centred on the common axis, each element having one end secured to one printed circuit board and its other end secured to another printed circuit board.

11. An antenna according to claim 10, wherein the printed circuit boards include a board having four conductor tracks extending radially with respect to the common axis, each track being electrically connected to a respective one of the elements, the four tracks comprising two track pairs with the tracks of each pair extending in opposite directions with respect to each other, and wherein the tracks of one pair have different electrical lengths from those of the other pair.

12. An antenna according to claim 11, wherein the feeder structure comprises a coaxial feeder line having an inner conductor and an outer conductor, and wherein, for each of the said track pairs, one of the associated helical elements is coupled to the inner conductor and the other is coupled to the outer conductor.

13. An antenna according to claim 1, wherein each helical element executes substantially a half turn around a notional cylindrical envelope.

14. An antenna according to claim 1, having four of the said helical elements all substantially identical to each other and centred on the common axis, the elements being coextensive in the axial direction.

15. An antenna according to claim 1, wherein each coupling structure comprises a respective insulative substrate bearing coupling elements in the form of electrical conductors extending between the helical elements and the feeder structure in said single respective plane perpendicular to said axis, and wherein the coupling elements of said at least one coupling structure include elements which are conductors following non-radial paths.

16. A method of making a radio frequency antenna which has a plurality of helical elements arranged around a common axis, a substantially axially located feeder structure, and at least two mounting members having coupling elements forming radio frequency conductive paths between the helical elements and the axis, wherein the method comprises: locating the helical elements with their axes coincident and with their respective ends lying in two spaced apart planes perpendicular to the common axis; securing a first of the mounting members to the helical element ends in one of the planes; bringing together the second of the mounting members and the assembly of the first mounting member and the helical elements so that the second mounting member is in a predetermined position parallel to and axially spaced from the first mounting member in which it is located on the other ends of the helical elements; securing the said other mounting member to the said other ends; and attaching the feeder structure to at least one of the mounting members.

17. A method according to claim 16, including the step of locating the helical elements around a cylindrical mandrel with one end of each element projecting beyond an end of the mandrel, and holding the elements on the mandrel while the first mounting member is secured to said projecting ends of said elements.

18. A method according to claim 17, in which the assembly of the helical elements and the first mounting member is held in a jig having two parts slidable relative to each other, the first mounting member being fitted in one of the jig parts and the second mounting member being fitted in the other of the jig parts.

* * * * *